US010743739B2

(12) United States Patent
Kerntopf et al.

(10) Patent No.: US 10,743,739 B2
(45) Date of Patent: Aug. 18, 2020

(54) DRY MOP CLEANER

(71) Applicants: Willy Kerntopf, Kelowna (CA); Michael Wayne Malinosky, Vernon (CA)

(72) Inventors: Willy Kerntopf, Kelowna (CA); Michael Wayne Malinosky, Vernon (CA)

(73) Assignees: Willy Kerntopf, Kelowna, B.C (CA); Michael Wayne Malinosky, Kelowna, B.C (CA)

( * ) Notice: Subject to any disclaimer, the term of this patent is extended or adjusted under 35 U.S.C. 154(b) by 0 days.

(21) Appl. No.: 15/590,796

(22) Filed: May 9, 2017

(65) Prior Publication Data

US 2017/0319043 A1 Nov. 9, 2017

Related U.S. Application Data

(60) Provisional application No. 62/333,711, filed on May 9, 2016.

(51) Int. Cl.
*A46B 17/06* (2006.01)
*A47L 13/50* (2006.01)
(Continued)

(52) U.S. Cl.
CPC ..... *A47L 13/50* (2013.01); *A47L 5/38* (2013.01); *A47L 9/0693* (2013.01); *A47L 9/242* (2013.01);
(Continued)

(58) Field of Classification Search
USPC ..... 15/38, 301, 310, 314
See application file for complete search history.

(56) References Cited

U.S. PATENT DOCUMENTS 1,898,887 A 2/1933 Naul
1,934,144 A * 11/1933 Reiser ..... A47L 13/502 15/142
(Continued)

FOREIGN PATENT DOCUMENTS

EP 1459673 9/2004

*Primary Examiner* — Joseph J Hail
*Assistant Examiner* — Shantese L McDonald

(57) ABSTRACT

An apparatus for cleaning mops comprising a top plate adapted to be engaged upon and spaced apart from a floor surface so as to form a cavity therebetween, an open face formed along an edge between the top plate and the floor surface and a plurality of protrusions extending from the top plate in a direction toward the floor surface, spaced apart along the open face, and a conduit extending between a proximate and a distal end, the proximate end extending through the top plate so as to place an interior of the conduit in fluid connection with the cavity, the distal end having a connector operable to be engaged in fluidic communication with an in-wall vacuum outlet. A method for cleaning a mop comprising passing a mop across a floor surface in proximity to an opening formed between a top plate and the floor surface, the top plate engaged upon the floor surface around a periphery thereof forming a cavity between the top plate and the floor surface, with the opening along an edge thereof into the cavity, agitating at least one element of the mop against at least one protrusion extending from the top plate into the opening; and drawing air and contents of the cavity through a conduit into an outlet of an in-wall wall vacuum system.

7 Claims, 4 Drawing Sheets

(51) Int. Cl.

| | |
|---|---|
| ***A47L 9/24*** | (2006.01) |
| ***A47L 9/06*** | (2006.01) |
| ***A47L 5/38*** | (2006.01) |
| ***A47L 13/20*** | (2006.01) |
| *A47L 11/40* | (2006.01) |
| *A47L 13/502* | (2006.01) |

(52) U.S. Cl.
CPC ..... *A47L 13/20* (2013.01); *A47L 11/40* (2013.01); *A47L 13/502* (2013.01)

(56) References Cited

U.S. PATENT DOCUMENTS

| | | | | |
|---|---|---|---|---|
| 2,031,374 | A | 2/1936 | Leidtke et al. | |
| 2,159,176 | A | 7/1936 | Nelson | |
| 2,791,792 | A | 5/1957 | Shearer, Sr. | |
| 2,984,856 | A | 5/1961 | Hunt et al. | |
| 2,990,562 | A | 7/1961 | Bishop | |
| 3,027,588 | A * | 4/1962 | Bierstock | A47L 5/38 15/301 |
| 3,122,772 | A | 3/1964 | Lipson | |
| 3,216,043 | A | 11/1965 | Lipson | |
| 3,411,174 | A | 11/1968 | Jordan | |
| 5,279,016 | A * | 1/1994 | Klassen | A47L 5/38 15/301 |
| 5,408,721 | A * | 4/1995 | Wall | A47L 5/38 15/301 |
| 5,504,967 | A * | 4/1996 | Graham | A47L 5/38 15/301 |
| 6,434,786 | B1 * | 8/2002 | Roberts | A47L 9/02 15/325 |
| 6,671,924 | B1 * | 1/2004 | Rood | A47L 5/38 15/301 |
| 2009/0183333 | A1 * | 7/2009 | Tsai | A47L 7/0047 15/310 |
| 2012/0304414 | A1 * | 12/2012 | Harman | A47L 5/38 15/315 |

* cited by examiner

DRY MOP CLEANER

CROSS REFERENCE TO RELATED APPLICATION

This application claims priority to U.S. Provisional Patent Application No. 62/333,711, filed May 9, 2016 entitled Dry Mop Cleaner.

BACKGROUND OF THE INVENTION

1. Field of Invention

The present invention relates generally to floor mounted dry dust mop cleaning devices and the disposal of debris collected by said mop through a wall installed central vacuum cleaning system via an attachment to the wall system.

2. Description of Related Art

Dry mops or dust mops with fringed edges are frequently used to collect and dispose of debris from uncarpeted floor areas or other flat surfaces, following which the dry mop must be cleaned. One method of such cleaning may be accomplished by agitating or striking the mop against an outdoor surface. It may be an inconvenience to the user to transport the mop outdoors to be cleaned, and the action of agitating or striking the mop against a surface may not sufficiently remove all particles lodged in the fringe fibres. Additionally, the agitation of the mop allows for the debris to be released back into the environment, which may be objectionable for the user.

Another method of cleaning the dry mop is to utilize a vacuum with a handheld attachment. This may be labour intensive and it may also be difficult or inconvenient to remove the vacuum device or hose from storage.

Previous devices have been provided which locate an opening above the floor to form a suction passage therein. Such devices require the mop head to be lifted or inserted into the device for cleaning. This may result in debris remaining on the floor, requiring additional labour to remove it. Examples of such devices include U.S. Pat. No. 2,159,176 to Nelson and U.S. Pat. No. 2,031,374 to Liedtke et al.

Other floor mounted devices utilize a built in vacuum system, but are located within the floor, requiring construction for installation, and they are not portable to other vacuum outlet locations. These floor mounted devices also do not include a means to assist with cleaning the mop fibres. Examples of such devices include U.S. Pat. No. 2,791,792 to Shearer, Sr and U.S. Pat. No. 2,984,856 to D. H. Hunt et al.

SUMMARY OF THE INVENTION

According to a first embodiment of the present invention there is disclosed an apparatus for cleaning mops comprising a top plate adapted to be engaged upon and spaced apart from a floor surface so as to form a cavity therebetween, an open face formed along an edge between the top plate and the floor surface and a plurality of protrusions extending from the top plate in a direction toward the floor surface, spaced apart along the open face. The apparatus further comprises a conduit extending between a proximate and a distal end, the proximate end extending through the top plate so as to place an interior of the conduit in fluid connection with the cavity, the distal end having a connector operable to be engaged in fluidic communication with an in-wall vacuum outlet.

The top plate may include a side wall extending therearound except along the open face, separating the top plate from the floor surface. The side wall may include a seal along a bottom edge thereof.

The protrusions may extend substantially to the floor surface. The conduit may include a length adjustment. The length adjustment may include a locking element.

The connector may include electrical contacts operable to activate a built-in vacuum. The connector may include a switch operable to selectively engage the electrical contacts with the in-wall vacuum.

According to a further embodiment of the present invention there is disclosed a method for cleaning a mop comprising passing a mop across a floor surface in proximity to an opening formed between a top plate and the floor surface, the top plate engaged upon the floor surface around a periphery thereof forming a cavity between the top plate and the floor surface, with the opening along an edge thereof into the cavity and agitating at least one element of the mop against at least one protrusion extending from the top plate into the opening. The method further comprises drawing air and contents of the cavity through a conduit into an outlet of an in-wall wall vacuum system.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
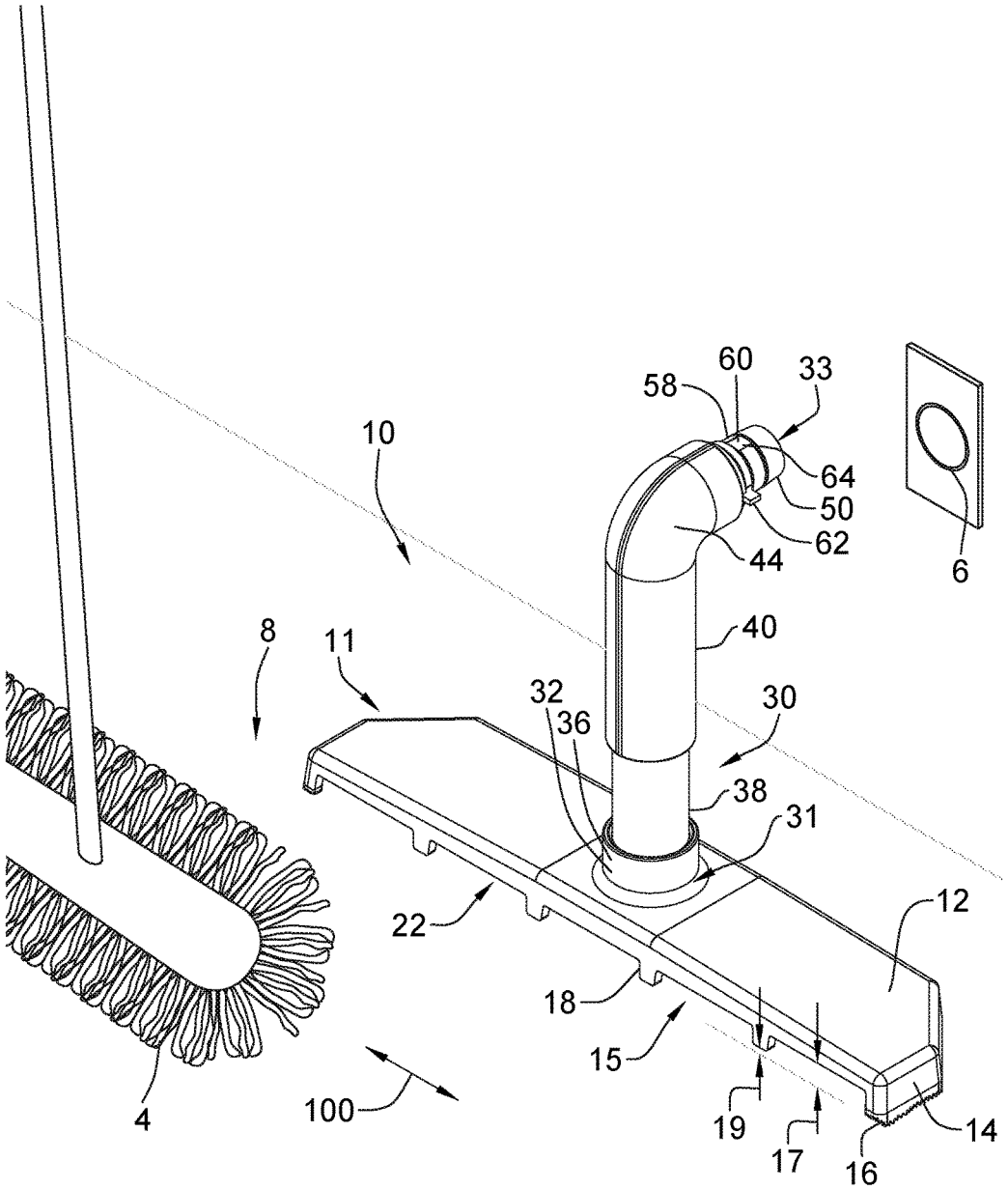
FIG. 1 is a perspective view of an apparatus for cleaning dry mops according to the first embodiment.
Figure 2:
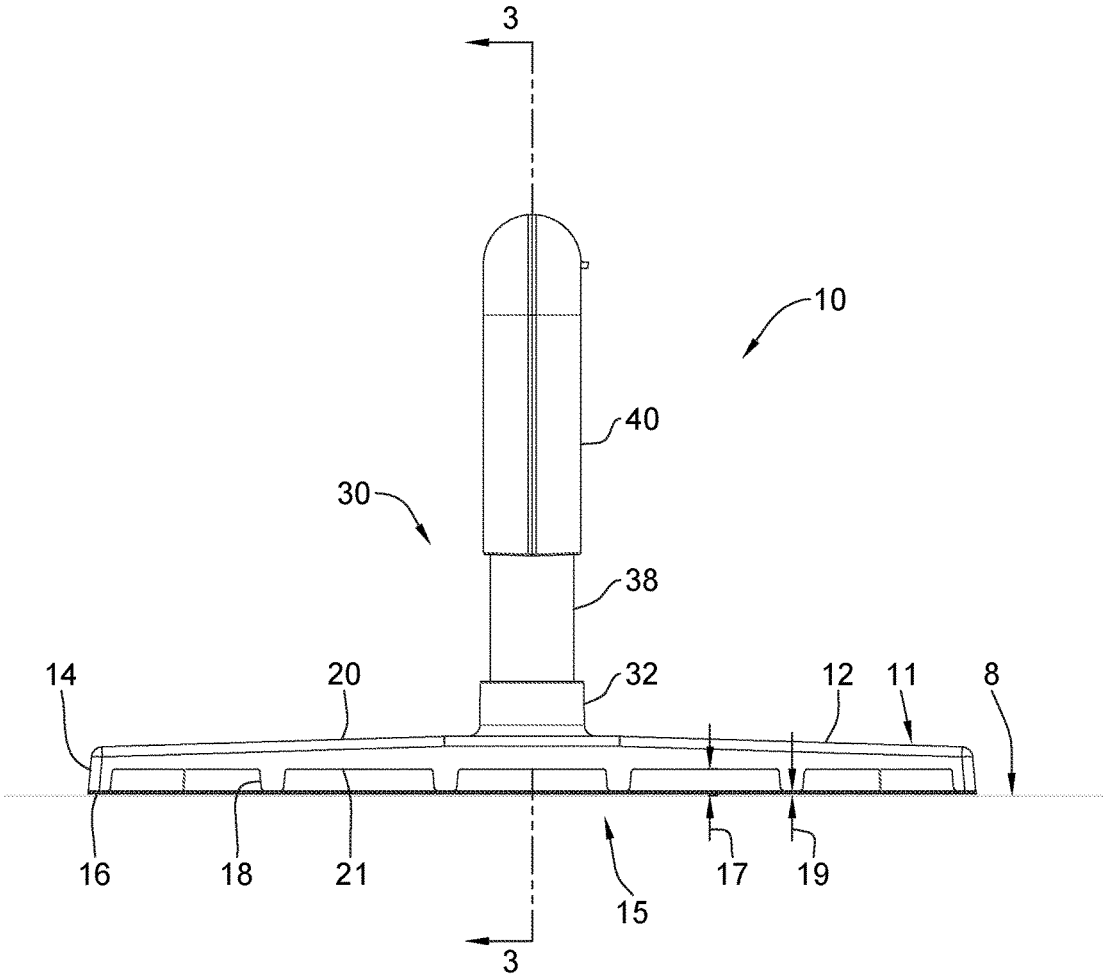
FIG. 2 is a front view of the apparatus of FIG. 1.
Figure 3:
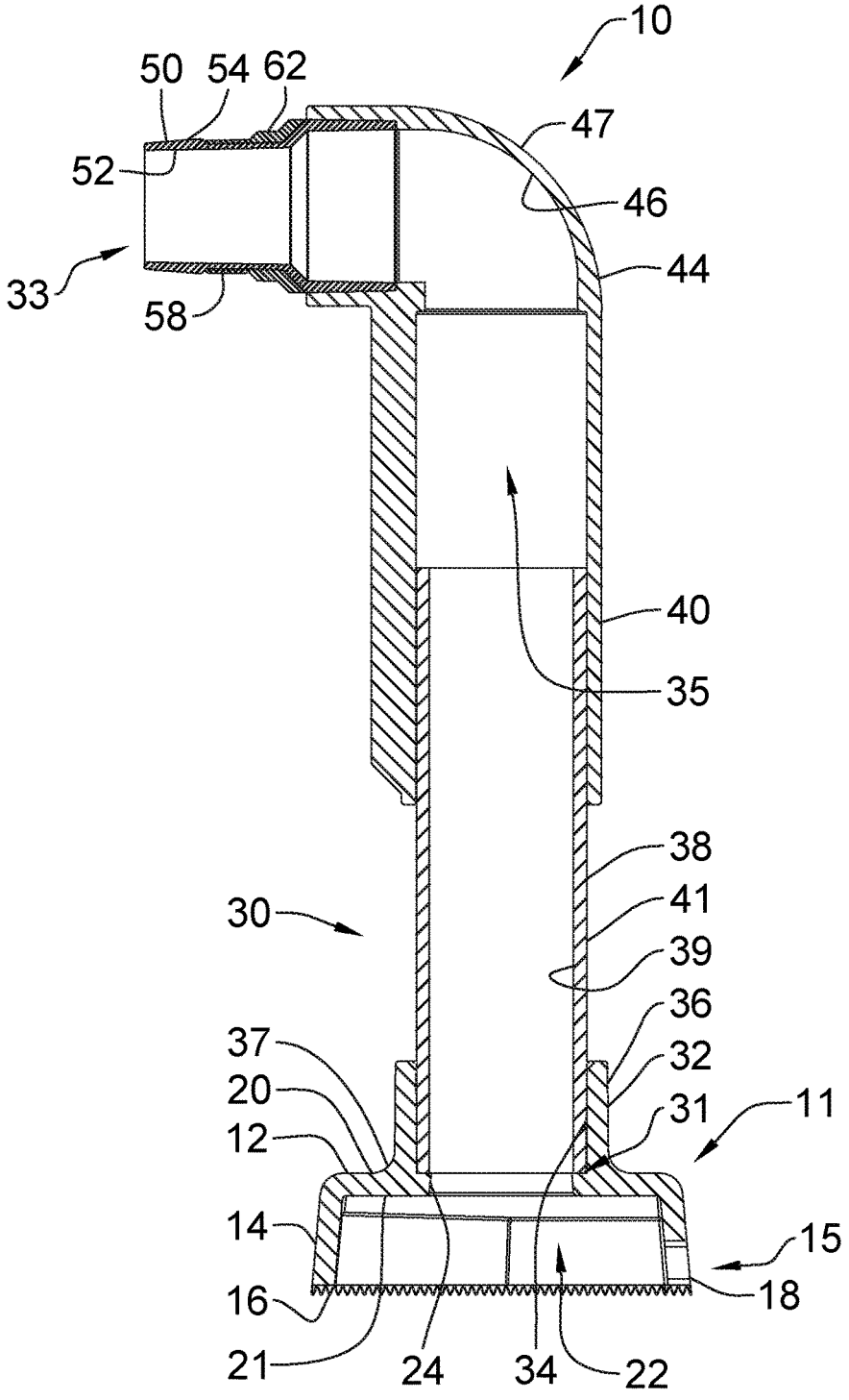
FIG. 3 is a detailed cross-sectional view of FIG. 2 as taken along the line 3-3.

Referring to FIGS. 1, 2 and 3, an apparatus for cleaning dry mops according to a first embodiment of the invention is shown generally at 10. The apparatus 10 comprises a head unit 11 and a connecting conduit 30. The head unit 11 is positioned on the floor 8 in proximity to a vacuum wall outlet 6 such that the conduit 30 extends from the head unit 11 to the wall outlet 6. A dry mop 4 may then be passed by and engaged with the head unit 11 at the floor 8 level, drawing debris away from the mop, as will be more fully described below.

Figure 4:
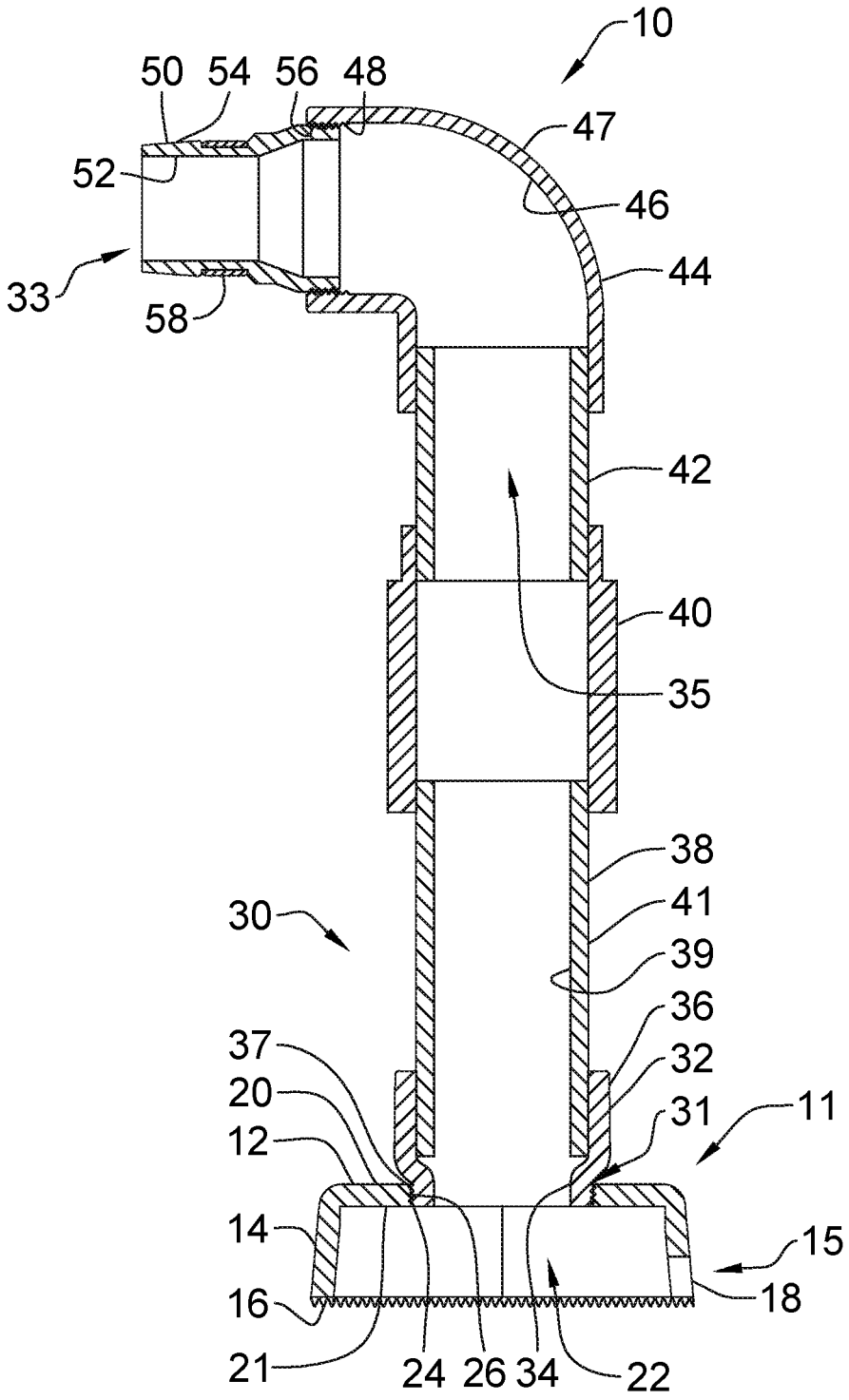
FIG. 4 is a further embodiment cross-sectional view of FIG. 2 as taken along the line 3-3.

The head unit 11 is comprised of top plate 12 having top and bottom surfaces, 20 and 21, respectively, and an optional sidewall 14 extending therearound except for along the open face 15, defining a cavity 22 between the top plate 12 and the floor 8 having a gap height, generally indicated at 17. The gap height may be between ¼ and 1½ inches (6 and 38 mm) although it will be appreciated that other dimensions may also be utilized provided sufficient air velocity through the open face 15 is maintained. An optional sidewall 14 may include a seal 16 along the bottom edge thereof, in contact with the floor 8. A plurality of protrusions 18 extend from the bottom surface 21 of the top plate 12 across the open face 15 and extend substantially to the floor 8. The height of the protrusions 18 may be less than the height of the gap height 17 to allow debris from the mop to pass under the protrusions 18 or may optionally extend to the floor. Where the protrusions are spaced above the floor a protrusion gap 19 may be provided. The protrusion gap may be up to ⅜ inches (10 mm) in height. While FIGS. 1 and 2 illustrate four protrusions 18 evenly spaced along the open face 15, it may be appreciated that more or less protrusions could be included, with variable spacing. The top plate 12 has a circular bore 24 which may include internal threading 26 therein, as illustrated in FIG. 4, the purpose of which will be described below.

A conduit 30 extends between the proximate and distal ends, 31 and 33, respectively, above the head unit 11, having a passage 35 (shown on FIG. 3) therethrough, through which debris can be drawn away from the floor 8 to a built-in vacuum wall outlet 6 when the end connector 50 is engaged in fluidic communication with the vacuum wall outlet 6, as will be more fully described below. The proximate end 31 of conduit 30, comprises a cylindrical collar member 32, having inner and outer surfaces, 34 and 36, respectively, and may be co-formed with the head unit 11, as illustrated in FIG. 3. It will be appreciated that the cylindrical collar member 32 may alternately extend through the circular bore 24 in the top plate 12, as illustrated in FIG. 4. Referring to FIG. 4, the outer surface 36 may include threading 37 thereon that is matable with the internal threading 26 of the circular bore 24, although it will be appreciated that the conduit 30 may be secured to the top plate through any other known means such as, by way of non-limiting example, adhesives or connectors.

An inner adjusting sleeve 38, with inner and outer surfaces 39 and 41, respectively, extends through the cylindrical collar member 32 with a push fit at the proximate end so that exterior surface 41 of the inner adjusting sleeve 38 mates with the inner surface 34 of the cylindrical collar member 32. An outer adjusting sleeve 40, having an inner diameter corresponding to the outer diameter of the inner adjusting sleeve 38, so as to form a friction fit therebetween, allows for the inner adjusting sleeve 38 to extend therewithin to variable locations at the distal end, providing height adjustment of the apparatus between the floor 8 and the vacuum wall outlet 6.

As illustrated in FIGS. 1 through 3, a cylindrical 90° elbow 44 is co-formed with the outer adjusting sleeve 40. Referring to FIG. 4, a further embodiment illustrates that a top pipe 42 may connect the outer adjusting sleeve 40 with the cylindrical 90° elbow 44 through the interior of both the outer adjusting sleeve 40 and elbow 44. The top pipe 42 has an outer diameter corresponding with the inner diameters of the outer adjusting sleeve 40 and the elbow 44, so as to be secured therein according to any known means, such as, by way of non-limiting example, welding, adhesive, clamps, compression fittings, threading or the like. The elbow 44 has interior and exterior surfaces 46 and 47, respectively. The interior surface 46 may include threading 48 therein at the distal end of the conduit 30, as illustrated in FIG. 4.

An end connector 50 has interior and exterior surfaces 52 and 54, respectively, and may include threading 56 on the exterior surface 54 at the proximate end, matable with the threading 48 of the elbow 44, as illustrated in FIG. 4. The distal end of the end connector 50 is sized and shaped to be receivable within a standard fit vacuum wall outlet 6, as is commonly known. While the diameter of the distal end of the end connector 50 illustrated herein is reduced between the proximate and distal ends, it can be appreciated that this may not be the case if the diameter of the elbow 44 or other components of the conduit 30 are reduced. An electrical contact 58 fabricated of a conductible metal material partially surrounds a section of the end connector 50, forming a gap 60 therebetween the ends, as seen in FIG. 1. A rotatable switch 62 includes a tab 64 within the gap 60, and may be used to adjust the location of the gap 60 around the exterior circumference of the end connector 50. When the electrical contact 58 is in a position to engage with two electrical contacts within the wall outlet 6, as is commonly known in the art, the electric circuit of the wall vacuum system is completed, initiating air flow through the vacuum system and therefore through the present apparatus. The switch 62 may be rotated to adjust the location of the gap 60 to turn the unit on or off, as is commonly known.

While the conduit 30 has been described above as shown in FIGS. 1 through 4, it can be appreciated that the conduit 30 could be formed in other embodiments, with various means to form the passage between the head unit 11 and the vacuum wall outlet 6, including, but not limited to, a hose extending between the head unit 11 and the wall outlet 6. Additionally, the height adjustment, as illustrated accomplished with the friction fit of inner adjusting sleeve 38 within outer adjusting sleeve 40 shown in FIGS. 3 and 4, could be accomplished by other means such as, by non-limiting example, a threaded connection, a clamped connection, bellows or the like. Additionally, one or more fixed length conduits may be provided to be selected by a user to accommodate different height wall outlets.

The apparatus may be formed of any suitable material, such as, by way of non-limiting example, metal, plastics, wood, ceramic or composite materials. The protrusions 18 may be fastened to the underside of the top plate 12 by any suitable means, such as, by way of non-limiting example, fasteners or adhesive, or may be co-formed as part of the top plate 12. Additionally, although the protrusions are illustrated as blocks, it will be appreciated that they may also be formed as fins, pins, coarse grating, cylinders or any other protruding shape as are commonly known. The top plate 12 could be produced in other shapes, such as curved, such that a gap remains between the top plate 12 and the floor 8 with or without the need for sidewall 14. The head unit 11 may be fabricated by any suitable means, such as machining, injection moulding or extrusion, by way of non-limiting example.

In operation, the user locates the apparatus 10 on the floor 8 in close proximity to a vacuum wall outlet 6. As the wall outlet 6 may be positioned at non-standard elevations from the floor 8, the height of the apparatus 10 may be adjusted by altering the position of inside inner adjusting sleeve 38 within outer adjusting sleeve 40 so that end connector 50 may be received within the standard fit vacuum wall outlet 6. The switch 62 may then be rotated to complete the electrical circuit within the wall outlet 6, initiating air flow through the vacuum system and therefore through the present apparatus. As the user passes a dry mop 4 along the open edge 15 of the apparatus 10 in a direction generally indicated at 100, the partial vacuum within cavity 22 serves to draw debris away from the mop, through passage 35 and into the vacuum system. As the user draws the mop along the open face 15 of the apparatus 10, the fibres along the outer edge of the mop are engaged with the protrusions 18, thereby loosening and releasing debris lodged on the mop fibres, drawing it away through the apparatus.

While specific embodiments of the invention have been described and illustrated, such embodiments should be considered illustrative of the invention only and not as limiting the invention as construed in accordance with the accompanying claims.

What is claimed is:

1. An apparatus for cleaning mops comprising:

a top plate; having a front face:

a side wall, including a seal along a bottom edge thereof, said side wall extending around said top plate except along said front face, so as to space said top plate apart from a floor surface so as to form a cavity having an open face formed by the absence of the sidewall along the front face, said cavity being directly between said floor and said top plate and sealed by the connection of the seal of the sidewall and the floor:

a plurality of protrusions extending from said top plate in a direction toward said floor surface, spaced apart along said open face; and a conduit extending between a proximate and a distal end, said proximate end extending through said top plate so as to place an interior of said conduit in fluid connection with said cavity, said distal end having a connector engaged in fluidic communication with an in-wall vacuum outlet;

wherein when the conduit is engaged to the vacuum wall outlet, the top plate, the side wall and the plurality of protrusions remain stationary.

2. The apparatus of claim 1 wherein said protrusions extend substantially to said floor surface.

3. The apparatus of claim 1 wherein said conduit includes a length adjustment.

4. The apparatus of claim 3 wherein said length adjustment includes a locking element.

5. The apparatus of claim 1 wherein said connector includes electrical contacts operable to activate a built-in vacuum.

6. The apparatus of claim 5 wherein said connector 5 includes a switch operable to selectively engage said electrical contacts with said in-wall vacuum.

7. A method for cleaning a mop comprising: passing a mop across a floor surface in proximity to an apparatus for cleaning mops comprising:

a top plate having a front face:

a side wall, including a seal along a bottom edge thereof, said side wall extending around said top plate except along said front face, so as to space said top plate apart from a floor surface so as to form a cavity having an open face formed by the absence of the sidewall along the front face, said cavity being directly between said floor and said top plate and sealed by the connection of the seal of the sidewall and the floor:

a plurality of protrusions extending from said top plate in a direction toward said floor surface, spaced apart along said open face; and a conduit extending between a proximate and a distal end, said proximate end extending through said top plate so as to place an interior of said conduit in fluid connection with said cavity, said distal end having a connector operable to be engaged in fluidic communication with an in-wall vacuum outlet;

wherein the conduit is engaged to the central builtin vacuum wall outlet, the top plate, the side wall and the plurality of protrusions remain stationary, agitating at least one element of said mop against at least one said protrusion and drawing air and contents of said cavity through a said conduit into said outlet of the in-wall vacuum system.

* * * * *